US009103184B2

(12) United States Patent
Hill, Jr. et al.

(10) Patent No.: US 9,103,184 B2
(45) Date of Patent: Aug. 11, 2015

(54) INFLOW CONTROL VALVE

(71) Applicant: Tejas Research and Engineering, LLC, The Woodlands, TX (US)

(72) Inventors: Thomas G. Hill, Jr., Conroe, TX (US); Robert C. Henschel, The Woodlands, TX (US)

(73) Assignee: Tejas Research & Engineering, LLC, The Woodlands, TX (US)

( * ) Notice: Subject to any disclaimer, the term of this patent is extended or adjusted under 35 U.S.C. 154(b) by 326 days.

(21) Appl. No.: 13/790,554

(22) Filed: Mar. 8, 2013

(65) Prior Publication Data

US 2014/0251613 A1 Sep. 11, 2014

(51) Int. Cl.
*E21B 34/08* (2006.01)
*E21B 34/06* (2006.01)

(52) U.S. Cl.
CPC ..... *E21B 34/08* (2013.01); *E21B 34/06* (2013.01)

(58) Field of Classification Search
CPC ..... E21B 34/06; E21B 34/08
See application file for complete search history.

(56) References Cited

U.S. PATENT DOCUMENTS

| | | | | |
|---|---|---|---|---|
| 4,475,599 | A | 10/1984 | Akkerman | |
| 4,603,742 | A | 8/1986 | Wong et al. | |
| 4,711,301 | A * | 12/1987 | Stringfellow | 166/187 |
| 4,969,482 | A | 11/1990 | Perrin et al. | |
| 5,957,197 | A | 9/1999 | Xia et al. | |
| 6,820,697 | B1 | 11/2004 | Churchill | |
| 2012/0305243 | A1 | 12/2012 | Hallundbæk et al. | |

FOREIGN PATENT DOCUMENTS

| | | |
|---|---|---|
| EP | 0681088 | 3/2000 |
| EP | 2458139 | 5/2012 |
| GB | 2464009 | 2/2009 |
| WO | WO2012080487 | 6/2012 |

* cited by examiner

*Primary Examiner* — Brad Harcourt
(74) *Attorney, Agent, or Firm* — Tumey L.L.P.

(57) ABSTRACT

A valve and valve assembly are provided to allow opening of flow channels through the wall of a tubular by increasing and then decreasing pressure in the tubular. Slidable seals having different areas are used to apply an axial force to a shuttle in the valve in response to differential pressure across the valve when in the closed position. The axial force shears a pin, releasing the shuttle. A decrease of pressure in the tubular can allow the valve to open in response to a spring force. Multiple valves may be placed along a tubular string and the valves may be opened all at substantially the same time or at time intervals determined by pressures applied inside the tubular.

13 Claims, 3 Drawing Sheets

INFLOW CONTROL VALVE

BACKGROUND OF INVENTION

1. Field of the Invention

This invention relates to valves for use in the wall of a string of tubulars, such as casing that is placed in wells. More particularly, a valve is provided that can be opened by a selected pressure inside the tubular and that may remain open.

2. Description of Related Art

To produce hydrocarbons from some reservoirs in the earth, long, horizontal holes are drilled through productive rock. To prevent collapse of the surrounding rock into the horizontal wellbore, casing must be placed in the holes before fluids can be withdrawn. The casing is normally pushed along the horizontal hole, but the frictional resistance between casing and the wall of the wellbore limits the distance that casing can be placed in horizontal wells using standard methods. One way that has been used to allow longer horizontal sections of casing in wells is to float the casing into the horizontal section using a low-density fluid inside the casing. In all wells, horizontal, deviated and vertical, openings in the wall of the casing must be provided for injection of fluids or production of fluids through the well.

After casing is placed in a well, in some wells cement is pumped down the casing and up the annulus between the casing and the wall of the wellbore. Openings for fluid flow through the wall of the casing are commonly made by perforating guns, which shoot a hole through the casing wall, the cement layer and a short distance into the surrounding rock. In other wells, an "open hole" is left outside the casing (no cement) and packers, made of a rubber sleeve that can be inflated or swellable material are placed at selected distances along the wellbore to prevent flow along the annulus outside casing. In this case, valves in the casing wall that can be opened by a mechanical device or by pumping balls down the casing are normally provided between the packers.

European Patent EP 0 681 088 discloses an annulus pressure-responsive valve that can be locked in the open position and then closed. The valve uses a power piston in a housing with an actuating piston. European Patent Application 2 458 139 discloses a valve that can be inserted into the wall of casing in a well by using the valve body to drill through the casing wall. UK Pat. App 2464009 discloses a method of using inflow control devices, which are commonly used to control the rate of flow into casing when there are multiple points of entry. The inflow control devices do not stop flow. U.S. Pat. Nos. 5,957,197 and 6,820,697 disclose downhole valves. It is common to place valves such as sliding sleeves in casing, which can be operated by mechanical tools inside the casing. Such device is disclosed in WO 2012/080487. Valves in casing operated mechanically by running tools or coiled tubing inside casing are often used in connection with hydraulic fracturing of multiple zones in a well. Many patents disclose downhole safety valves, which serve primarily the purpose of effecting a reliable positive closure of the bore of a production tubing string in the event of an emergency.

BRIEF SUMMARY OF THE INVENTION

A valve is provided that can be opened by a selected increase of pressure inside casing or other tubular followed by a selected value of pressure reduction in the tubular. The valve may be used in operations to float a casing into a horizontal section of wellbore, to open a casing at selected locations for production or injection (including hydraulic fracturing operations), and for any other uses where a valve that is opened by internal pressure in the tubular and remains open is needed.

BRIEF DESCRIPTION OF THE SEVERAL VIEWS OF THE DRAWING(S)

Figure 3A:
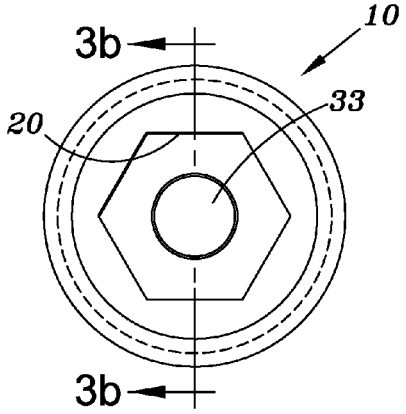
Figure 3B:
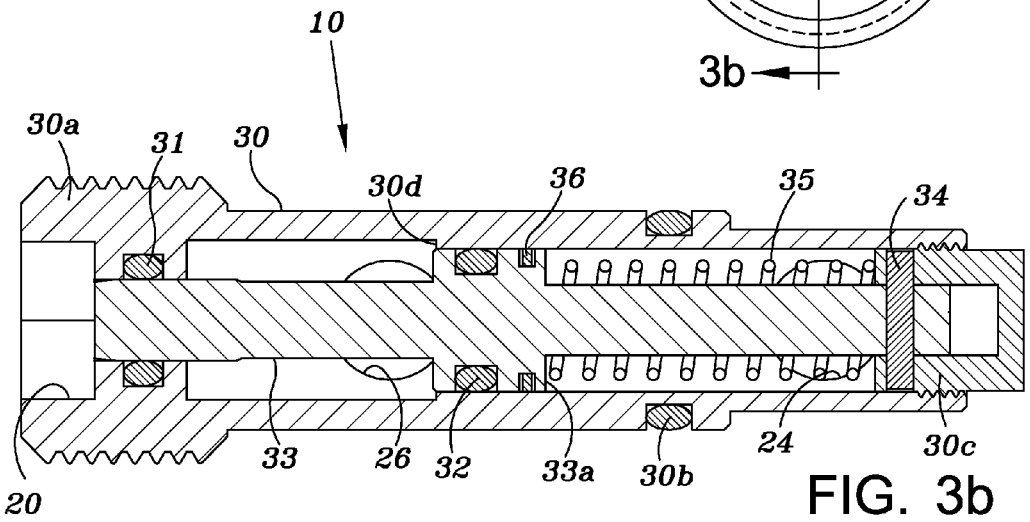

FIG. 3*a* is a view of the proximate end of the valve. FIG. 3*b* is a cross-sectional view of the valve in the closed position.

Figure 4:
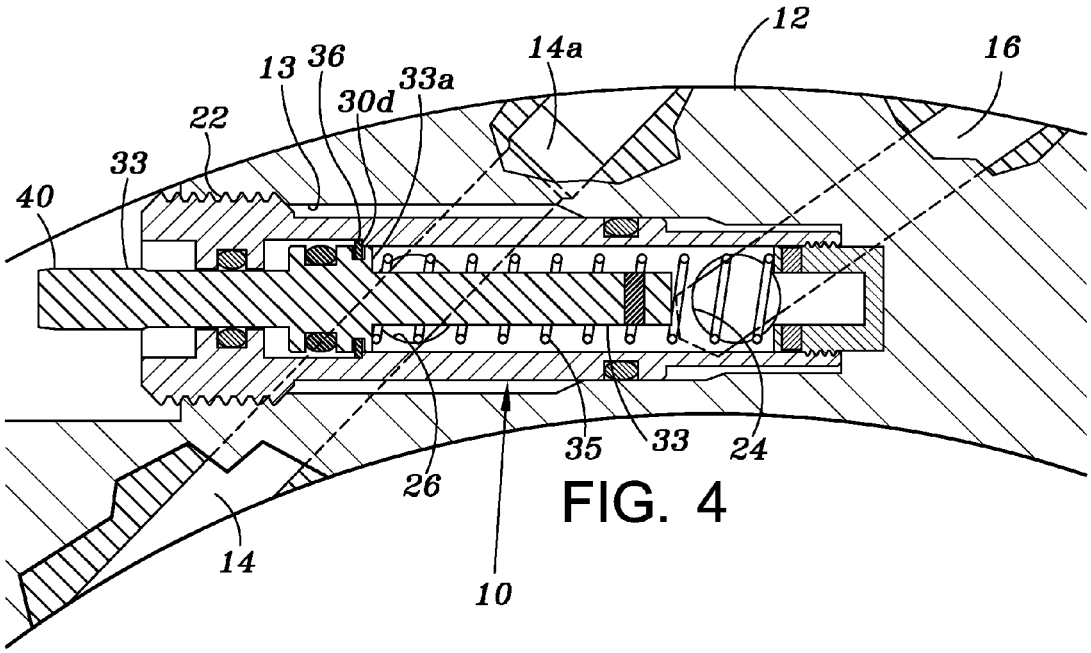

FIG. 4 is a cross-sectional view of the valve in the open position while mounted in a tubular.

DETAILED DESCRIPTION OF THE INVENTION

Figure 1:
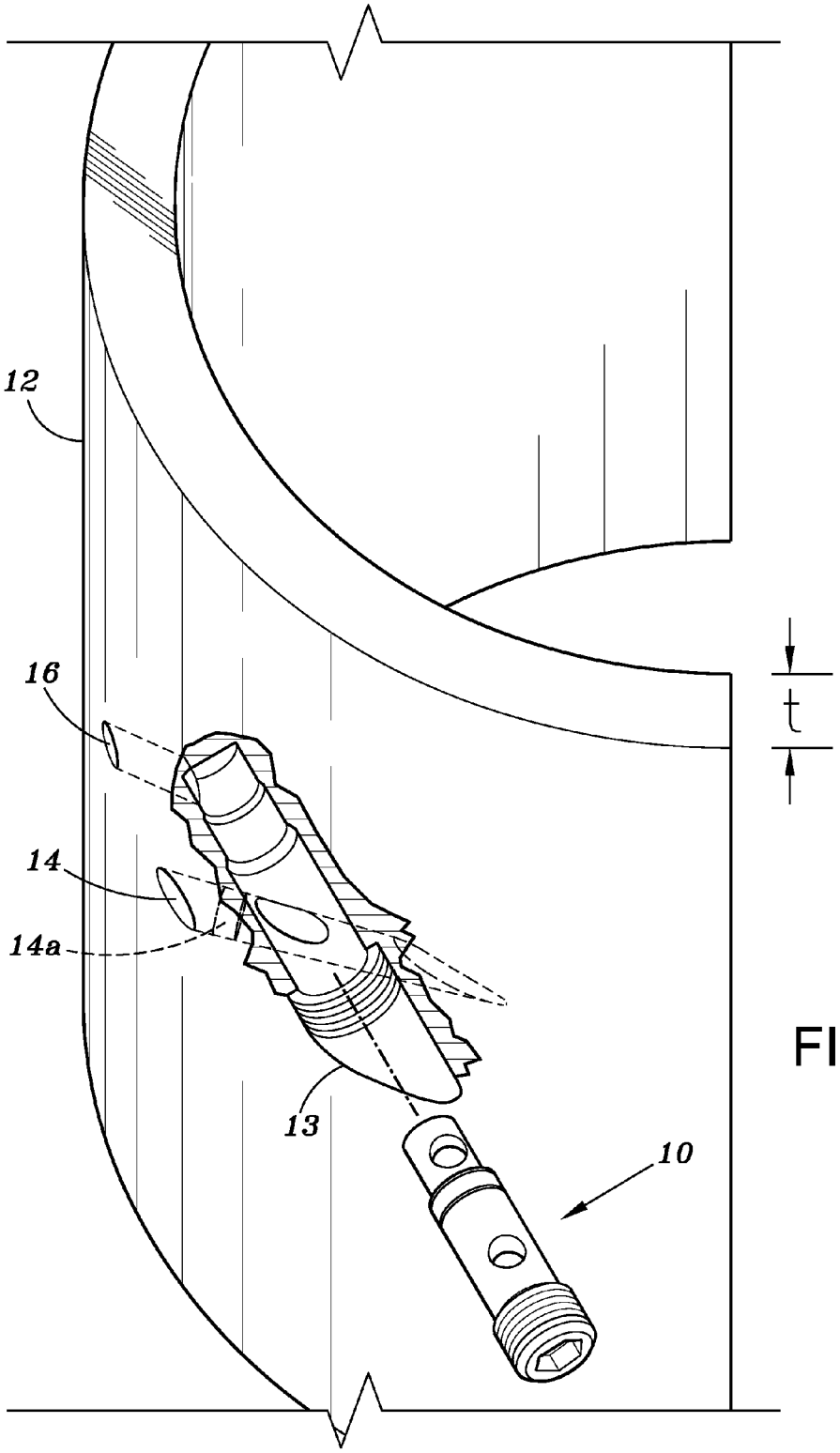
FIG. 1 is an isometric view of the valve disclosed herein and a section of the tubular where it is to be installed.

Referring to FIG. 1, inflow control valve 10 is shown in position to be inserted into the wall of tubular sub 12, having a wall thickness, t, which may be a coupling for a string of tubulars. Alternatively, the sub may have any selected length. The wall thickness t is effective to provide the mechanical strength of a tubular string to be placed in a well with valve 10 in place. Receptor hole 13 is sized to receive valve 10 and may include internal threads adapted to receive external threads on valve 10. Alternatively, valve 10 may be held in place in receptor hole 13 by a clip ring and indexed so as to be held in a selected direction in hole 13 and to align ports to increase flow area when the valve is opened. The indexing may be provided by a protrusion or indentation on body 30 or marking on the proximate end of body 30 such that the valve can be aligned in receptor hole in a selected direction. O-ring 30*b* provides a seal outside body 30. Inner port 14 is drilled to intersect receptor hole 13 at a selected position and extend through the inner wall of sub 12. Plug 14*a* is placed in the outer portion of inner port 14. Outer port 16 is drilled through the outer surface of sub 12 to intersect receptor hole 13 at a selected position. A screen may be placed over outer port 16 to prevent particles entering the port and valve and plugging a flow channel after the valve opens. Screens outside flow control valves in casing are well known in industry.

Figure 2:
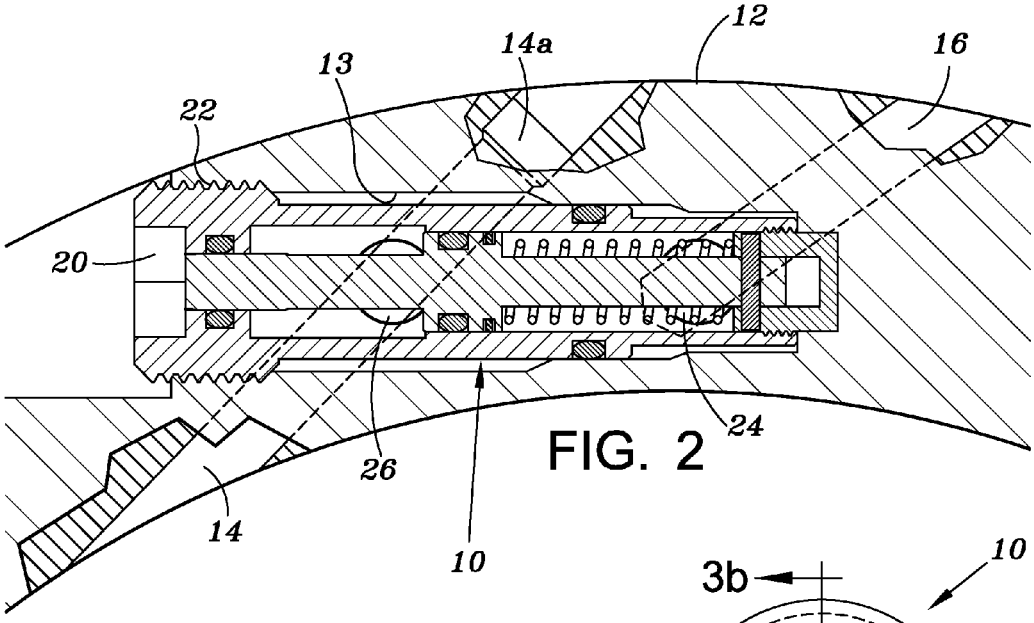
FIG. 2 is a cross-section view of the valve installed in a tubular.

Referring to FIG. 2, valve 10 is shown installed in receptor hole 13 of sub 12. Threads 22 may be used to fasten valve 10 into hole 13 of sub 12, or a clip ring may be used. Torque may be applied to valve 10 by use of hexagonal key hole 20 to align or make up the threads. When the valve is installed, distal hole 24 of the valve intersects outer port 16 and proximate hole 26 of the valve intersect inner port 14. The holes in the tubular may be drilled or milled with a CNC machine or a conventional machine.

Referring to FIG. 3*a*, a view of the proximate end of valve 10 is shown. Shuttle 33 is preferably centered around the axis of the valve. Referring to FIG. 3*b*, valve body 30 has distal hole 24 and proximate hole 26, which are disposed in body 30 so as to intersect inner port 14 and outer port 16 of sub 12 when valve 10 is installed in sub 12, as shown in FIG. 2. Outside threads 30*a* match inside threads in sub 12. O-ring 31 seals around the proximal end of shuttle 33 with a sealing area $A_1$. O-ring 32, having a larger diameter than o-ring 31, exerts a force in the distal direction when differential pressure exists from inside to outside the tubular. Split retainer ring 36 is compressed to fit inside body 30 and sized to spring out when it passes shoulder 30*d* so as to hold shuttle 33 in the valve-open position. Shear pin 34, selected to shear at a selected axial force on shuttle 33, is inserted in body base 30*c* and shuttle 33 before base 30*c* is inserted into valve body 30. Body base 30*c* may be fastened in place by threads or other fastening method. Pressure inside sub 12 is applied between o-ring 31 and o-ring 32. This pressure exerts an axial force on shuttle toward the distal end of the shuttle. Shear pin 34 is selected such that it is sheared at a force corresponding to a selected differential pressure between the inside and outside of sub 12. After shear pin 34 has failed, shuttle 33 moves to place the distal end of shuttle 33 in contact with the end of the inside opening in base 30*c*. The valve is still closed when pressure inside sub 12 is at or above the pressure to shear pin 34.

As pressure inside sub 12 is decreased, a value is reached such that spring 35 moves shuttle 33 toward the proximal end of the valve. The spring constant of spring 35 may be selected to control the pressure inside sub 12 at which shuttle 33 moves. FIG. 4 shows the position of shuttle 33 after shear pin 34 has been sheared and pressure has decreased inside sub 12 to allow shuttle 33 to move toward the proximal end of the valve. In FIG. 4, shuttle 33 has moved past the position where o-ring 32 and retaining ring 36 pass shoulder 30*d*. This allows equalization of pressure across o-ring 32. Distal hole 24 intersects outside port 16 and proximal hole 26 intersects inside port 14. [The valve is open when o-ring 32 passes 26. In this position, split ring 36 insures that the valve is permanently open, independent of pressures inside and outside sub 12. Turkey button 40, which may be a bright color, may be placed on the proximal end of shuttle 33 to allow easy inspection to determine if the valve is open. Alternatively, turkey button 40 may be replaced with a sensor to indicate if the valve is open. A signal from the sensor may be communicated to surface using known communication technology or the sensor may be read by a device run on slick line, coiled tubing or logging cable.

The force required to shear a pin can be selected over a wide range. For example, valves may be placed in a tubular string and adapted to shear the pin in different valves over a range of differential pressures across the valve. All valves in a tubular string remain closed until the shear pin in one valve is caused to fail, so selected valves can be opened by increasing pressure in the tubular only to the value required to open a selected valve or valves. When some valves are open and other valves requiring pressure are to be opened, open valves may be temporarily closed by dropping one or more ball sealers to close the entrance to inside port 14 of open valves or degradable solid particles may be pumped into the well to plug open valves, using technology known in industry.

Multiple valves can be placed around the circumference of a tubular at about the same axial distance along the tubular. This may be required to achieve a desired flow rate into or out of the tubular at the same depth or distance along a horizontal section of a well.

Valve body 30 may be constructed from standard coupling stock. The valves in a tubular string, such as a casing string, may be inserted at the surface in drilled ports that are threaded to receive the valves or that are adapted to a clip ring. Beans may be inserted with the valves or inside the valves to control flow rate. The beans or valves may be constructed of erosion-resistant materials. Flow from the valves enters the casing tangentially to the inside wall, minimizing erosion of a tubular inside the casing. Grooves in the outside surface of sub 12 (not shown) may be used to increase flow area if an outside port is in contact with a wellbore.

One application of the valve disclosed herein is to allow a casing to be floated during installation in a horizontal section of a wellbore. A horizontal casing string may have valves placed at selected locations along the casing. Packers may be placed between the valves to isolate flow in the annulus to different valves. The packers may be swell packers or mechanically expanded packers, using technology known in industry. Light fluid, usually nitrogen gas, is placed inside the casing, using technology known in industry. After the casing has been "landed" at the selected location, the gas may be partially or completely displaced with liquid. Pressure inside casing is increased to shear the pins in selected valves along the casing, Pressure in the casing is then reduced to allow the valves to open. All valves may be opened at substantially the same time. Alternatively, valves having different pressures to shear the shear pins in the valves may be used, such that valves may be selectively opened at different distances along a casing string, Open valves may be temporarily plugged to allow application of pressure across closed valves for their opening.

The valves disclosed here may be used in a well that is to be acidized or hydraulically fractured. Valves may be opened selectively at different locations, if desired. The method and apparatus described here may be used in vertical or horizontal wells. When wells are hydraulically fractured, fluid is injected at a high rate. Then fluid containing solid particles, called a "proppant" is injected. It may be desirable to increase the area of the flow channel through the valves for production or injection of fluids. For such applications, it may be desirable for the flow path through a valve to increase over that shown in FIG. 4 at the beginning of a fracture treatment. To facilitate increase in flow area, shuttle 33 and spring 35 may be constructed of materials that erode quickly. Even valve body 30 may be made partially or completely of material that is easily eroded, such as a soft metal like brass or bronze. After fluid has been pumped through an open valve it may erode completely, increasing the area for flow of fracturing fluid or produced fluids. In wells to be produced through the valves, it may be desirable to use materials that are quickly eroded by fluid flow.

In another application, multiple valves may be placed along a horizontal wellbore or at different depths in a vertical well and some valves in the casing opened to allow production for a period of time while other valves remain closed. When it is desirable to open new zones or intervals for production, open valves may be temporarily plugged by injecting balls or degradable particles into the well before increasing pressure to a higher value to open additional zones. Alternatively, open valves may be permanently plugged by a resin that solidifies in the valves or by other methods before new zones are opened by increasing pressure in the casing sufficient to shear the pins in other valves.

Locations of ends, openings and holes are identified by the terms "proximate" and "distal." In the figures, proximate is leftward and distal is rightward. It should be understood that these terms are used for identification, and the directions can be reversed in defining the terms to achieve the same results.

Although the present invention has been described with respect to specific details, it is not intended that such details should be regarded as limitations on the scope of the invention, except to the extent that they are included in the accompanying claims.

We claim:

1. A valve for placement in a tubular, comprising:

a body having an axis, a proximate end and a distal end having a base and proximal and distal openings through the body and being adapted for sealing in a receptor hole;

a shuttle adapted to be placed in the body and having an axis, proximate and distal ends and a hole transverse to the axis adapted to receive a shear pin, the hole being in proximity to the distal end;

a first slidable seal between the body and the shuttle, the first slidable seal having a first area and being attached to the shuttle between the proximate end of the shuttle and the proximal opening through the body when the valve is an a closed position;

a second slidable seal between the body and the shuttle, the second slidable seal having a second area and being rigidly attached to the body and being disposed between the proximal end of the body and the proximal opening in the body, the first slidable seal having an area greater than the area of the second slidable seal;

a spring confined between the first slidable seal and the distal end of the body; and a shear pin adapted to the shear pin hole in the shuttle and a hole in the base of the body.

2. The valve of claim 1 wherein the body is adapted for sealing in a receptor hole by an o-ring and external threads on the body.

3. The valve of claim 1 wherein the body is adapted for sealing in a receptor hole by an o-ring on the body and a c-clamp.

4. The valve of claim 1 further comprising an indexing mark or protrusion or indentation on the valve for aligning the valve in a receptor hole.

5. The valve of claim 1 wherein one or more of the shuttle, the spring or the body is formed from a material selected for its erosion rate in a flowing fluid.

6. The valve of claim 5 wherein the material is brass or bronze.

7. The valve of claim 1 further comprising a split ring disposed in a groove on the shuttle.

8. An assembly for controlling flow through the wall of a tubular, comprising:

the valve of claim 1; and a tubular sub having an outside surface and an inside surface and having a receptor hole through the outside surface adapted for receiving the valve, a distal hole through the outside surface disposed to intersect the distal opening through the body of the valve and a proximal hole drilled from the inside surface to intersect the proximal opening through the body of the valve when the valve is in the receptor hole.

9. The sub of claim 7 further comprising a groove on the external surface of the sub for decreasing flow resistance to the hole through the outside surface.

10. The sub of claim 7 further comprising a screen disposed over the distal hole through the outside surface for preventing entry of particles into the hole.

11. A method for forming a flow path through the wall of a tubular at a selected location in the tubular, comprising:

placing the assembly of claim 7 at a selected location in the tubular;

placing the tubular into a well;

increasing pressure in the tubular to shear the pin in the valve; and decreasing pressure in the tubular to allow the valve to open and form the flow path.

12. A method for forming a plurality of flow paths through the wall of a tubular at spaced apart locations, comprising:

placing a first assembly of claim 7 at a first location in the tubular;

placing a second assembly of claim 7 at a second location in the tubular;

placing the tubular in a well;

increasing pressure inside the tubular to create a pressure in the tubular sufficient to shear the shear pin in the first assembly;

without decreasing pressure, increasing pressure inside the tubular to create a pressure in the tubular sufficient to shear the shear pin in the second assembly; and decreasing pressure inside the tubular to allow the valve in the first and the second assembly to open and form a first and second flow path through the valves.

13. The method of claim 12 further comprising injecting a ball or particles in the well to plug the flow paths.

* * * * *